US008368502B2

(12) United States Patent
Washizaki et al.

(10) Patent No.: US 8,368,502 B2
(45) Date of Patent: Feb. 5, 2013

(54) SURFACE-MOUNT CURRENT FUSE

(75) Inventors: Tomoyuki Washizaki, Fukui (JP); Toshiyuki Iwao, Fukui (JP); Kenji Senda, Fukui (JP); Takashi Watanabe, Fukui (JP); Kazutoshi Matsumura, Osaka (JP); Seiji Tsuda, Fukui (JP)

(73) Assignee: Panasonic Corporation, Osaka (JP)

( * ) Notice: Subject to any disclaimer, the term of this patent is extended or adjusted under 35 U.S.C. 154(b) by 180 days.

(21) Appl. No.: 12/159,476

(22) PCT Filed: Mar. 14, 2007

(86) PCT No.: PCT/JP2007/055083

§ 371 (c)(1),
(2), (4) Date: Jun. 27, 2008

(87) PCT Pub. No.: WO2007/119358

PCT Pub. Date: Oct. 25, 2007

(65) Prior Publication Data

US 2009/0015365 A1 Jan. 15, 2009

(30) Foreign Application Priority Data

| | | |
|---|---|---|
| Mar. 16, 2006 | (JP) | 2006-072332 |
| Apr. 18, 2006 | (JP) | 2006-114176 |
| Aug. 22, 2006 | (JP) | 2006-224870 |
| Dec. 28, 2006 | (JP) | 2006-354294 |
| Feb. 15, 2007 | (JP) | 2007-034803 |

(51) Int. Cl.

| | |
|---|---|
| ***H01H 85/04*** | (2006.01) |
| ***H01H 85/00*** | (2006.01) |
| ***H01H 69/02*** | (2006.01) |

(52) U.S. Cl. ..... 337/297; 337/142; 337/290; 337/293; 337/296; 29/623

(58) Field of Classification Search ..... 337/186, 337/297, 142, 290, 293, 296; 29/623
See application file for complete search history.

(56) References Cited

U.S. PATENT DOCUMENTS
(Continued)

FOREIGN PATENT DOCUMENTS

| | | |
|---|---|---|
| JP | 55-56328 | 4/1980 |
| JP | 58-122350 | 8/1983 |

(Continued)

OTHER PUBLICATIONS

International Search Report Dated Jun. 19, 2007.

(Continued)

*Primary Examiner* — Bradley Thomas
(74) *Attorney, Agent, or Firm* — Pearne & Gordon LLP

(57) ABSTRACT

A surface mount current fuse of the present invention includes a first base which has a recess and is smaller in width at the other end than at one end in the longitudinal direction, and a second base which has the same shape as the first base. The first base and the second base are combined to form a box-shaped body by joining the lower surface of the second base to the upper surface of the upper surface of the first base in such a manner that one end of the first base and the other end of the second base are in contact with each other. The recess of the first base and the recess of the second base form a space portion in which to dispose an element portion. The borderline between the first base and the second base passes through the center point on a side surface of the body. As a result, the surface mount current fuse has high production efficiency.

16 Claims, 15 Drawing Sheets

U.S. PATENT DOCUMENTS

| | | | | | |
|---|---|---|---|---|---|
| 1,700,080 | A | * | 1/1929 | Sandin | 337/222 |
| 3,962,668 | A | * | 6/1976 | Knapp, Jr. | 337/228 |
| 4,158,187 | A | * | 6/1979 | Perreault | 337/248 |
| 4,511,875 | A | * | 4/1985 | Arikawa | 337/201 |
| 4,559,514 | A | * | 12/1985 | Arikawa | 337/201 |
| 4,563,666 | A | * | 1/1986 | Borzoni | 337/252 |
| 4,599,596 | A | * | 7/1986 | Arikawa et al. | 337/201 |
| 4,608,548 | A | * | 8/1986 | Borzoni | 337/201 |
| 4,656,453 | A | * | 4/1987 | Reeder | 337/236 |
| 4,894,633 | A | * | 1/1990 | Holtfreter | 337/278 |
| 4,920,327 | A | * | 4/1990 | Arikawa et al. | 337/231 |
| 4,996,509 | A | * | 2/1991 | Bernstein | 337/232 |
| 5,140,294 | A | * | 8/1992 | Rohrer et al. | 337/278 |
| 5,214,406 | A | * | 5/1993 | Reese et al. | 337/231 |
| 5,235,307 | A | * | 8/1993 | Oh | 337/228 |
| 5,296,833 | A | * | 3/1994 | Breen et al. | 337/297 |
| 5,432,378 | A | * | 7/1995 | Whitney et al. | 257/529 |
| 5,440,802 | A | * | 8/1995 | Whitney et al. | 29/623 |
| 5,606,301 | A | * | 2/1997 | Ishimura | 337/290 |
| 5,617,069 | A | * | 4/1997 | Arikawa et al. | 337/227 |
| 5,621,375 | A | * | 4/1997 | Gurevich | 337/297 |
| 5,642,090 | A | * | 6/1997 | Arikawa | 337/297 |
| 5,726,620 | A | * | 3/1998 | Arikawa | 337/227 |
| 5,726,621 | A | * | 3/1998 | Whitney et al. | 337/297 |
| 5,739,740 | A | * | 4/1998 | Stark et al. | 337/248 |
| 5,812,046 | A | * | 9/1998 | Brown et al. | 337/290 |
| 5,926,084 | A | * | 7/1999 | Frochte | 337/231 |
| 5,994,994 | A | * | 11/1999 | Ito et al. | 337/248 |
| 6,013,358 | A | * | 1/2000 | Winnett et al. | 428/210 |
| 6,034,589 | A | * | 3/2000 | Montgomery et al. | 337/296 |
| 6,147,585 | A | * | 11/2000 | Kalra et al. | 337/248 |
| 6,778,061 | B2 | * | 8/2004 | Nakano et al. | 337/248 |
| 2003/0142453 | A1 | * | 7/2003 | Parker et al. | 361/104 |
| 2004/0021546 | A1 | * | 2/2004 | Nakano et al. | 337/186 |
| 2004/0085179 | A1 | * | 5/2004 | Ackermann | 337/159 |
| 2004/0183646 | A1 | * | 9/2004 | Jollenbeck et al. | 337/228 |
| 2004/0184211 | A1 | * | 9/2004 | Bender et al. | 361/104 |
| 2005/0057337 | A1 | * | 3/2005 | Richter et al. | 337/187 |
| 2005/0141164 | A1 | * | 6/2005 | Bender et al. | 361/104 |
| 2006/0119465 | A1 | * | 6/2006 | Dietsch | 337/186 |
| 2007/0075822 | A1 | * | 4/2007 | Pachla et al. | 337/297 |

FOREIGN PATENT DOCUMENTS

| | | | |
|---|---|---|---|
| JP | 59-119545 | | 8/1984 |
| JP | 64-52285 | | 3/1989 |
| JP | 01-287905 | A | 11/1989 |
| JP | 3-35640 | U | 4/1991 |
| JP | 05-166454 | A | 7/1993 |
| JP | 5-69847 | U | 9/1993 |
| JP | 08-096694 | | 4/1996 |
| JP | 08-106845 | A | 4/1996 |
| JP | 08-222117 | | 8/1996 |
| JP | 10-177835 | | 6/1998 |
| JP | 10-283906 | A | 10/1998 |
| JP | 11-260238 | | 9/1999 |
| JP | 11-273541 | | 10/1999 |
| JP | 3074595 | | 10/2000 |
| JP | 2002-208342 | A | 7/2002 |
| JP | 2002-245922 | | 8/2002 |
| JP | 2002-343223 | A | 11/2002 |
| JP | 2004-014224 | A | 1/2004 |
| JP | 2004-152518 | A | 5/2004 |
| JP | 2004-253218 | | 9/2004 |

OTHER PUBLICATIONS

Japanese Office action for JP2006-224870 dated Jan. 18, 2011.
Japanese Office action for JP2006-114176 dated Jan. 18, 2011.
Machine translation for previously cited reference JP08-222117.
Machine translation for previously cited reference JP2002-245922.
Machine translation for previously cited reference JP08-096694.
Machine translation for previously cited reference JP11-273541.
Japanese Office Action No. 2006-224870 dated Aug. 2, 2011.

* cited by examiner

PRIOR ART

SURFACE-MOUNT CURRENT FUSE

THIS APPLICATION IS A U.S. NATIONAL PHASE APPLICATION OF PCT INTERNATIONAL APPLICATION PCT/JP2007/055083.

TECHNICAL FIELD

The present invention relates to a surface mount current fuse which melts when an overcurrent flows therethrough to protect electronic devices.

BACKGROUND ART

FIG. 27 is a sectional view of a conventional surface mount current fuse, and FIG. 28 is a perspective view of an essential part of the fuse. As shown in FIGS. 27 and 28, the conventional surface mount current fuse includes ceramic case 271, ceramic lid 272, space portion 273 formed therebetween, element portion 274 disposed in space portion 273, and external electrodes 275 disposed at both ends of case 271 and connected to element portion 274.

One of the prior arts related to the present invention is Patent Document 1 shown below.

The aforementioned conventional surface mount current fuse has the following inconveniences. It is not easy to form case 271 into a complex shape as shown in FIG. 28 and moreover to form space portion 273 therein because it is made of ceramic material. In addition, it is not production-efficient to design case 271 and lid 272 in different shapes.

The present invention is directed to provide a surface mount current fuse with high production efficiency. Patent Document 1: Japanese Patent Unexamined Publication No. 1996-222117

SUMMARY OF THE INVENTION

The present invention is directed to provide a surface mount current fuse including: a first base which has a recess and is smaller in width between the bottom surface and the other end than between the bottom surface and one end in the longitudinal direction; and a second base having the same shape as the first base. The first and second bases are combined to form a box-shaped body by joining the lower surface of the second base to the upper surface of the first base in such a manner that one end of the first base and the other end of the second base are in contact with each other. The recess of the first base and the recess of the second base form a space portion in which to place an element portion. When the junction boundary between the first base and the second base is projected on a side surface of the body, the borderline between the first base and the second base passes through the center point on the side surface of the body.

The present invention is also directed to provide a surface mount current fuse including: a first base made of resin; a second base made of resin and disposed on the upper surface of the first base; a body formed of the first and second bases; a pair of third external electrodes at both ends of the body; an element portion between the upper surface of the first base and the lower surface of the second base, the element portion being connected to the pair of third external electrodes. Each of the upper surface of the first base and the lower surface of the second base is provided with a recess, and the recesses are opposed to each other to form a space portion in which to dispose the element portion.

The present invention is also directed to provide a surface mount current fuse including a first base which has insulating properties and is provided with a pair of metal films integrally covering at least the upper, lower, and end surfaces at both ends thereof; a second base disposed on the upper surface of the first base, the second base having insulating properties and being provided with a pair of metal films integrally covering at least the upper, lower, and end surfaces at both ends thereof; a body formed of the first and second bases; and an element portion between the upper surface of the first base and the lower surface of the second base, the element portion being connected to the metal film. Each of the upper surface of the first base and the lower surface of the second base are provided with a recess, and the recesses are opposed to each other to form a space portion in which to dispose the element portion.

REFERENCE MARKS IN THE DRAWINGS

Figure 1:
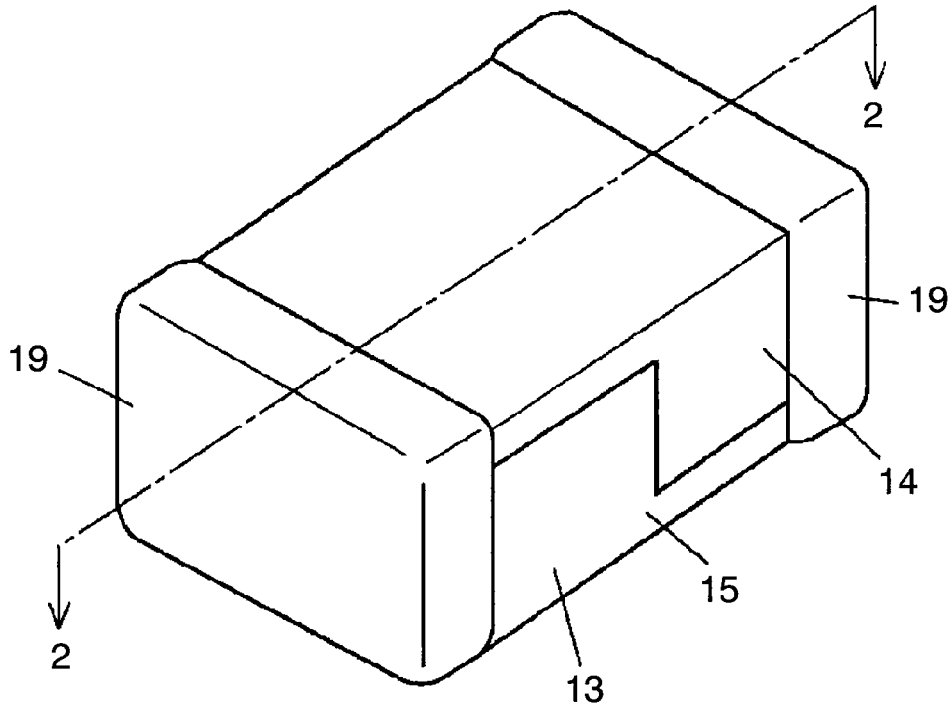
FIG. 1 is a perspective view of a surface mount current fuse according to a first embodiment of the present invention.

11*a*, 11*b*, 56*a*, 56*b* recess
12*a* one end
12*b* other end
13, 51 first base
14, 52 second base
15, 53 body
16, 32, 57 space portion
17, 35, 55 element portion
18 first groove
58 second groove
19, 33, 54 third external electrode
28 first external electrode
29 second external electrode
31 case
31*a* bottom
31*b* lid
34 melting portion
59 pressing device
60 metal layer
70 metal film
80 notch portion

DETAILED DESCRIPTION OF PREFERRED EMBODIMENTS

First Embodiment

A surface mount current fuse according to a first embodiment of the present invention is described as follows with reference to drawings.

Figure 2:
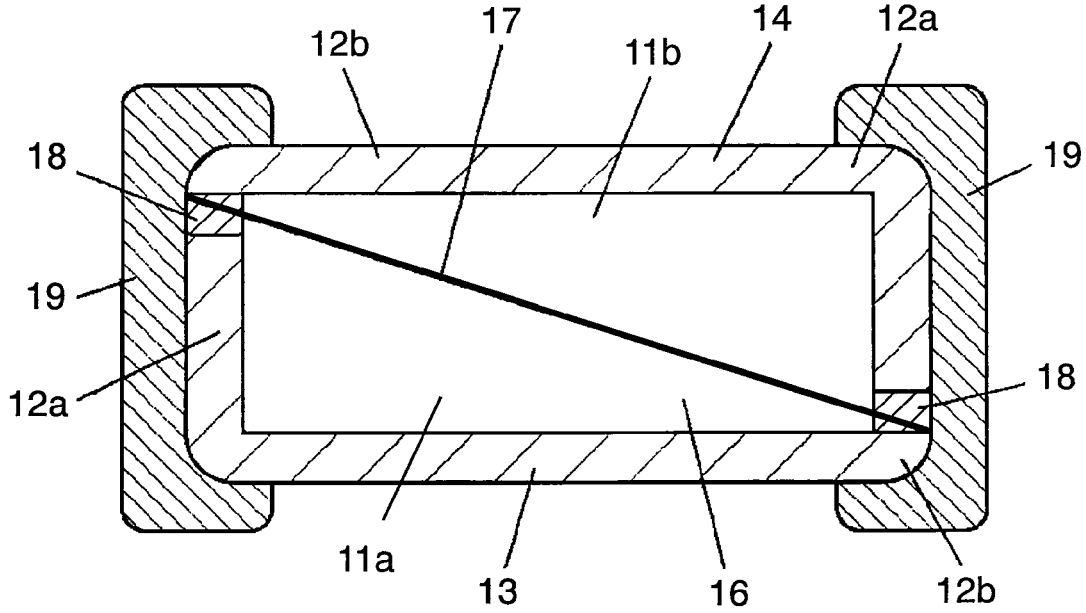
FIG. 2 is a sectional view taken along line 2-2 of FIG. 1.
Figure 3:
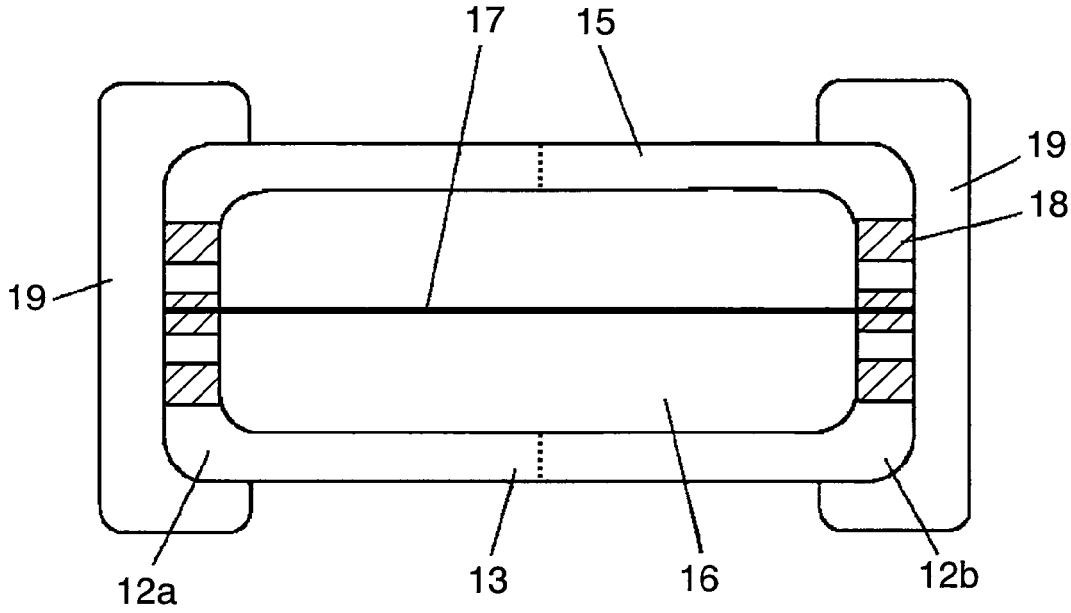
FIG. 3 is a top perspective view of an essential part of the surface mount current fuse according to the first embodiment of the present invention.
Figure 4:
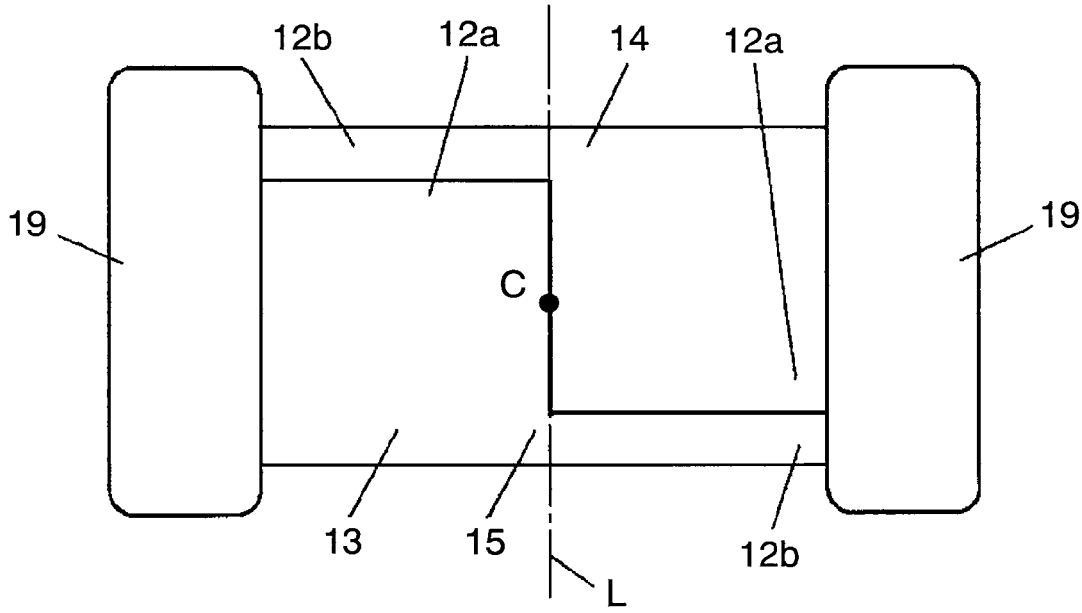
FIG. 4 is a side view of the surface mount current fuse according to the first embodiment of the present invention.

FIG. 1 is a perspective view of the surface mount current fuse according to the present first embodiment. FIG. 2 is a sectional view taken along line 2-2 of FIG. 1. FIG. 3 is a top perspective view of an essential part of the surface mount current fuse. FIG. 4 is a side view of the surface mount current fuse.

As shown in FIGS. 1 to 4, the surface mount current fuse according to the present embodiment includes first base 13 and second base 14 having substantially the same shape. First base 13 has recess 11*a* and is L-shaped with a width smaller between the bottom surface and other end 12*b* than between the bottom surface and one end 12*a* in its longitudinal direction. First and second bases 13, 14 are combined to form box-shaped body 15 by joining the lower surface of second base 14 to the upper surface of first base 13 in such a manner that one end 12*a* of first base 13 and other end 12*b* of second base 14 are in contact with each other. Recess 11*a* of first base 13 and recess 11*b* of second base 14 form space portion 16 in which to dispose element portion 17. When the junction boundary between first and second bases 13, 14 is projected on a side surface of body 15, the borderline between first and second bases 13, 14 passes through center point C on the side surface.

First and second bases 13, 14 are made of insulating material such as ceramic or resin, and have substantially the same shape because they are formed from the same mold. Each of first and second bases 13, 14 consists of two sections of different widths: it is wide on the side of one end 12*a* and narrow on the side of other end 12*b* of the center line L in the longitudinal direction of body 15. As shown in FIG. 2, each of first and second bases 13, 14 has a plurality of first grooves 18 at one end 12*a* in the longitudinal direction. Although there are three first grooves 18 in FIG. 3, there may be more or fewer of them. First and second bases 13, 14 have the same number of first grooves 18 at the same positions.

Body 15 is formed of first and second bases 13, 14 by placing them 180 degrees opposite each other. More specifically, the lower surface of second base 14 is joined to the upper surface of first base 13 in such a manner that one end 12*a* of first base 13 and other end 12*b* of second base 14 are in contact with each other, and that other end 12*b* of first base 13 and one end 12*a* of second base 14 are in contact with each other. Body 15 thus formed is box-shaped and has a cross section of square or rectangular shape.

The upper surface of first base 13 and the lower surface of second base 14 are joined with an adhesive. Body 15 may be covered with a heat-shrinkable tube in order to protect space portion 16 from the entry of flux or solder during solder dipping and hence to prevent deterioration of element portion 17.

Space portion 16 shown in FIG. 2 is formed by facing recess 11*a* of first base 13 and recess 11*b* of second base 14 when the upper surface of first base 13 and the lower surface of second base 14 are joined. Element portion 17 is made of a highly conductive metal such as silver, copper, nickel, or aluminum. Element portion 17 is disposed in space portion 16 and heated to a high temperature to be melted when an overcurrent flows therethrough, thereby blocking the current flow. One end of element portion 17 is disposed on the upper surface at one end 12*a* of first base 13, whereas the other end is disposed on the upper surface at the other end of first base 13. Since the width of first and second bases 13, 14 is smaller between the bottom surface and other end 12*b* than between the bottom surface and one end 12*a* in its longitudinal direction, one end and the other end of element portion 17 are disposed on different levels. This makes it easy to increase the length of element portion 17.

Element portion 17 is extended between one of the plurality of first grooves 18 formed at one end 12*a* of first base 13 and one of the plurality of first grooves 18 formed at one end 12*a* of second base 14. In FIG. 3, element portion 17 is extended between the middle of three first grooves 18 at one side and the middle at the other side. Element portion 17 can have the largest length when it is extended between a left-side first groove 18 and a right-side first groove 18. Choosing the first grooves 18 in which to dispose element portion 17 can fine-adjust the length of element portion 17, thereby allowing the adjustment of the fusion characteristics and the fine-adjustment of the resistance of element portion 17.

Box-shaped body 15 is provided at its both ends with third external electrodes 19 formed of rectangular-column-shaped electrode caps functioning as connection terminals between element portion 17 and the outside. The rectangular-column-shaped electrode caps are attached to box-shaped body 15 by press-fitting their column portions into both ends of body 15, thereby reinforcing the joint between first and second bases 13, 14.

Figure 5:
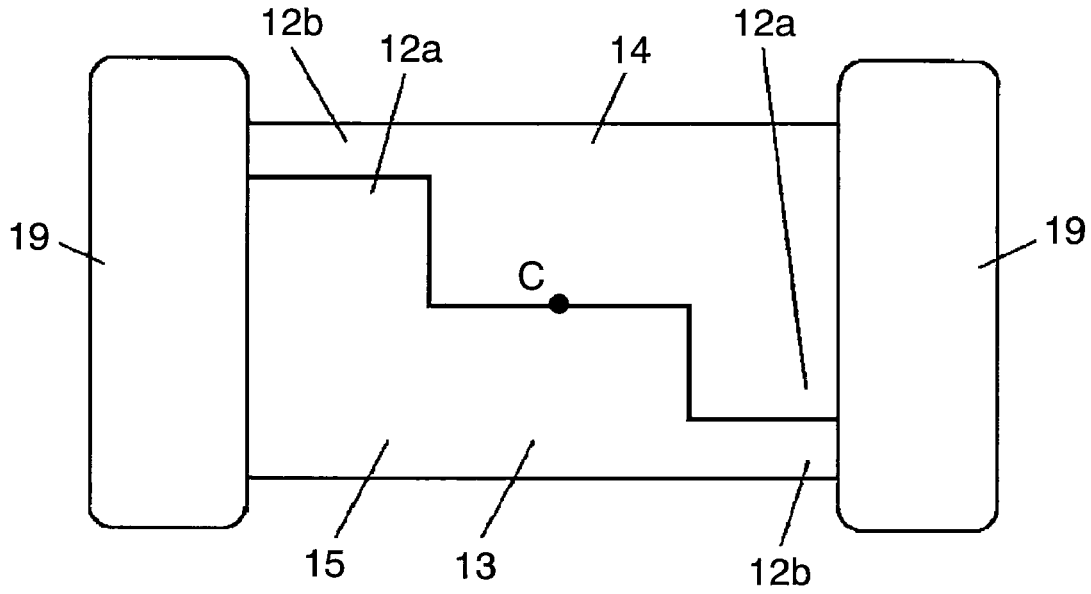
FIG. 5 is a side view of another example of the surface mount current fuse according to the first embodiment of the present invention.
Figure 6:
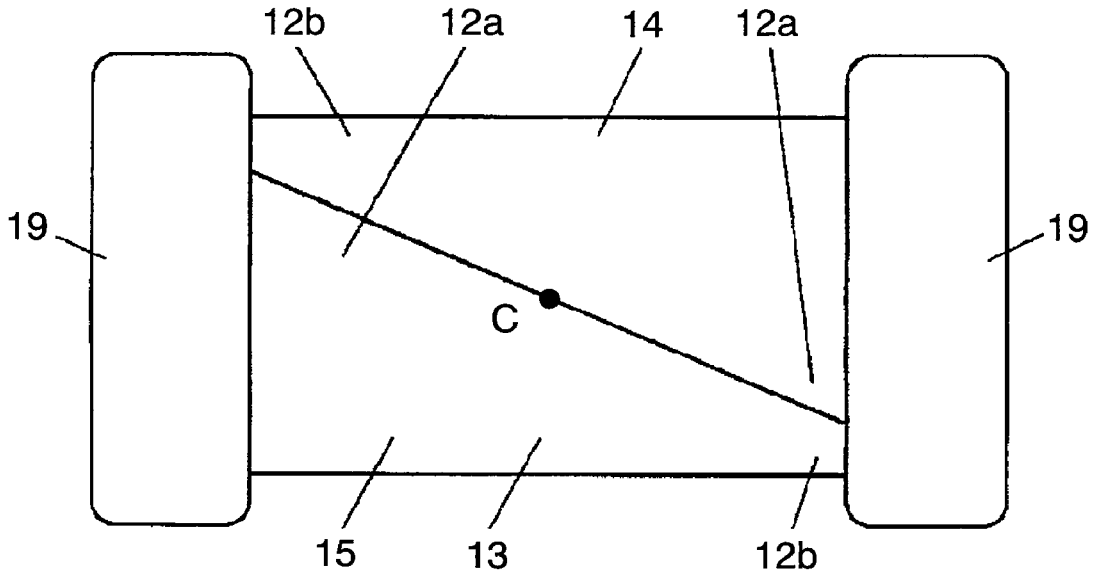
FIG. 6 is a side view of further another example of the surface mount current fuse according to the first embodiment of the present invention.

FIGS. 5 and 6 are side views of other examples of the surface mount current fuse according to the first embodiment of the present invention. As shown in FIG. 5, first base 13 may consist of three or more sections of different widths between one end 12*a* and other end 12*b*, unlike the two sections of different widths shown in FIG. 4. Alternatively, when the junction boundary between first and second bases 13, 14 is projected on a side surface of body 15, the borderline between first and second bases 13, 14 may be straight as shown in FIG. 6. In this case, the upper surface of first base 13 is flat, allowing the adhesive to be easily applied with a roller, thereby improving production efficiency.

First and second bases 13, 14 can be closely combined with each other by making the borderline between first and second bases 13, 14 pass through center point C on the side surface of body 15 when seen from the side surface. This prevents deterioration of element portion 17 due to contact with flux or solder during solder dipping and hence deterioration of fusion characteristics.

A method for producing the surface mount current fuse according to the present first embodiment is described as follows.

First of all, first and second bases 13, 14 having recesses 11*a* and 11*b*, respectively, as shown in FIGS. 1 to 3 are formed from the same mold. First and second bases 13, 14 are L-shaped with a width smaller between the bottom surface and other end 12*b* than between the bottom surface and one end 12*a* in their longitudinal direction. Then, the plurality of first grooves 18 are formed in the same positions of first and second bases 13, 14.

Next, element portion 17 is extended between one of the plurality of first grooves 18 of first base 13 and one of the plurality of first grooves 18 of second base 14. The lower surface of second base 14 is joined to the upper surface of first base 13 in such a manner that one end 12*a* of first base 13 and other end 12*b* of second base 14 are in contact with each other, while the adhesive is being applied to the upper surface of first base 13. As a result, box-shaped body 15 is complete. In this case, recess 11 of first base 13 and recess 11 of second base 14 are opposed to each other to form space portion 16 in which to dispose element portion 17. Finally, third external electrodes 19 are disposed at both ends of body 15.

In the present first embodiment, first and second bases 13, 14 can be formed from the same mold because they have substantially the same shape, thereby improving production efficiency. In addition, first and second bases 13, 14 can be closely combined by making the borderline between them pass through the center point C on the side surface of body 15. This prevents deterioration of element portion 17 due to flux or solder during solder dipping and hence deterioration of fusion characteristics.

In the surface mount current fuse, increasing the length of element portion 17 in space portion 16 can reduce radiation from both ends of element portion 17 to third external electrodes 19 when an overcurrent flows therethrough at an emergency. Increasing the length of element portion 17 also increases the resistance of element portion 17, allowing its center portion to be heated to a high temperature. As a result, element portion 17 has fast acting characteristics, or melts quickly at an emergency even when it has a large diameter. The longer element portion 17 has a larger heat capacity, thereby providing a surface mount current fuse with high resistance to inrush current.

In the present first embodiment, first and second bases 13, 14 have a width smaller between the bottom surface and other end 12*b* than between the bottom surface and one end 12*a* in its longitudinal direction. Therefore, one end and the other end of element portion 17 can be disposed on different levels, allowing element portion 17 to have a large length. In addition, the first grooves 18 in which to dispose element portion 17 can be chosen to increase the length of element portion 17, thereby providing fast acting characteristics and resistance to inrush current.

Thus, the surface mount current fuse according to the present first embodiment obtains high production efficiency by requiring only one mold, and also provides fast acting characteristics and inrush current resistance by increasing the length of element portion 17.

Second Embodiment

A surface mount current fuse according to a second embodiment of the present invention is described as follows with reference to drawings.

Figure 7:
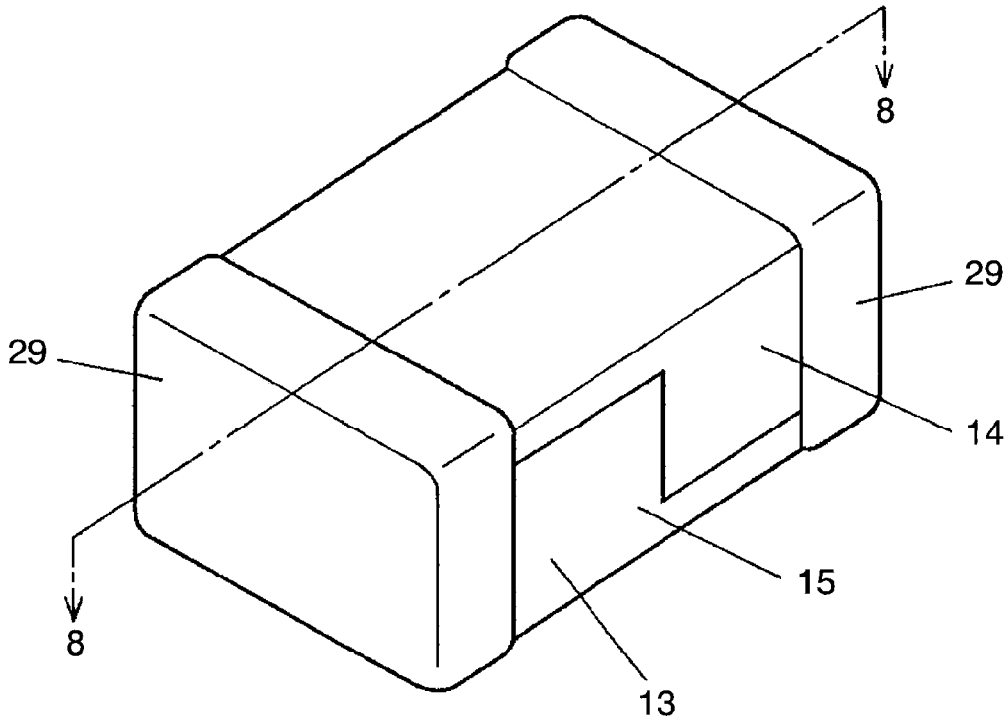
FIG. 7 is a perspective view of a surface mount current fuse according to a second embodiment of the present invention.
Figure 8:
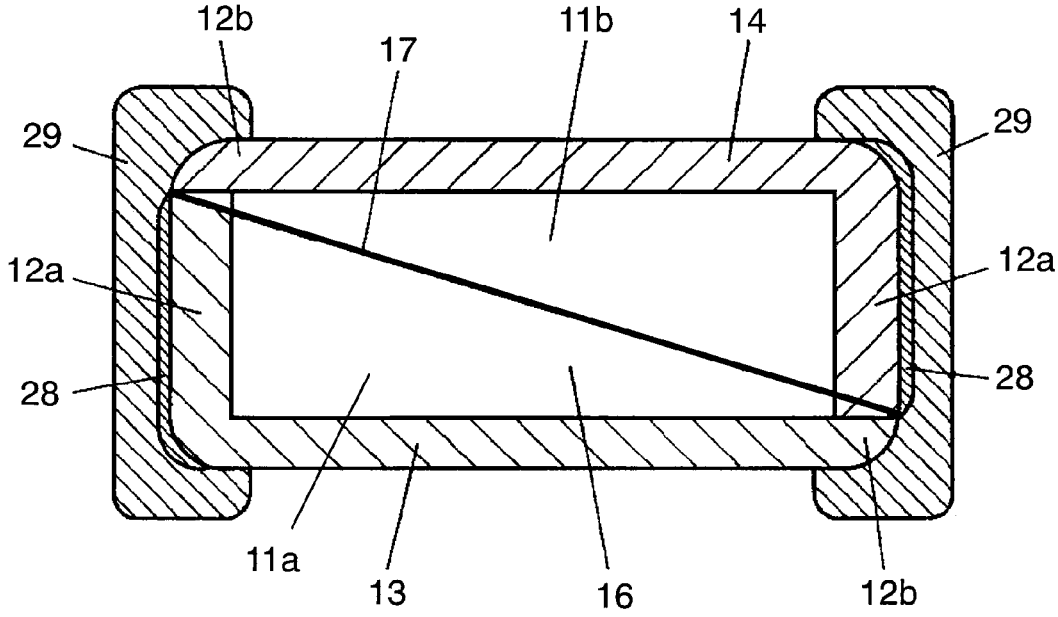
FIG. 8 is a sectional view taken along line 8-8 of FIG. 7.

FIG. 7 is a perspective view of the surface mount current fuse according to the present second embodiment, and FIG. 8 is a sectional view taken along line 8-8 of FIG. 7.

As shown in FIGS. 7 and 8, the surface mount current fuse according to the present embodiment includes first base 13 and second base 14 having substantially the same shape. First base 13 has recess 11*a* and is smaller in width between the bottom surface and other end 12*b* than between the bottom surface and one end 12*a* in its longitudinal direction. First and second bases 13, 14 are combined to form box-shaped body 15 by joining the lower surface of second base 14 to the upper surface of first base 13 in such a manner that one end 12*a* of first base 13 and other end 12*b* of second base 14 are in contact with each other. Recess 11*a* of first base 13 and recess 11*b* of second base 14 form space portion 16 in which to dispose element portion 17. The borderline between first and second bases 13, 14 passes through the center point on the side surface of body 15.

Figure 9:
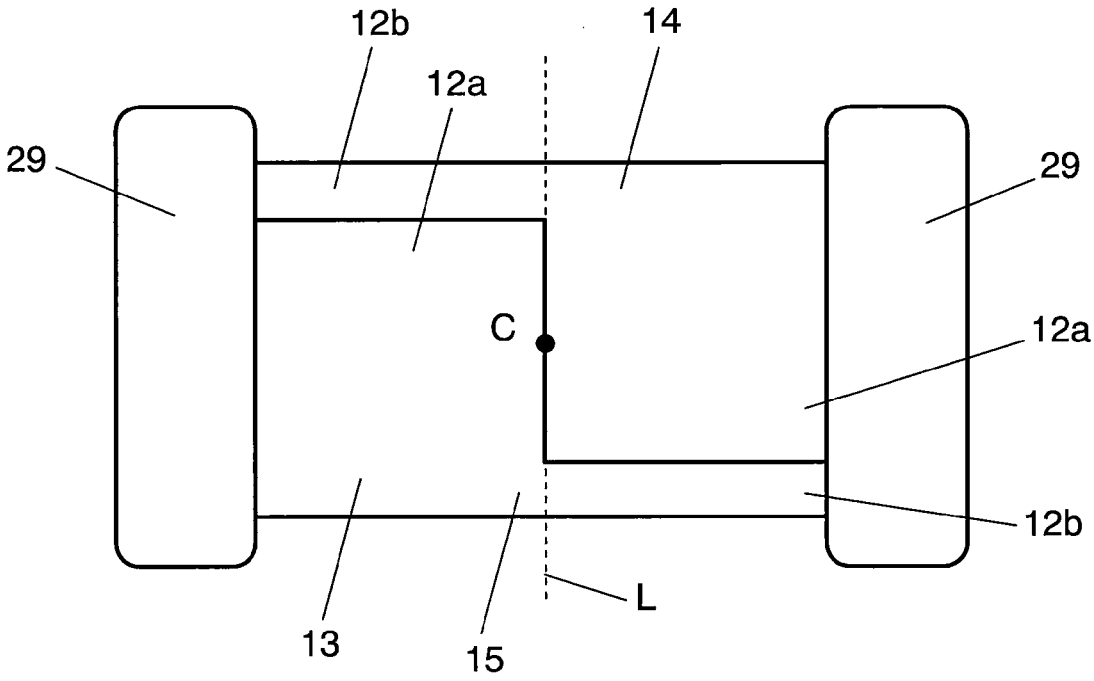
FIG. 9 is a side view of the surface mount current fuse according to the second embodiment of the present invention.

FIG. 9 is a side view of the surface mount current fuse according to the second embodiment of the present invention. In FIG. 9, first and second bases 13, 14 are made of insulating material such as ceramic or resin and have substantially the same shape because they are formed from the same mold. Each of first and second bases 13, 14 consists of two sections of different widths: it is wide on the side of one end 12*a* and narrow on the side of other end 12*b* of the center line L in the longitudinal direction of body 15.

As shown in FIG. 8, first and second bases 13, 14 are each provided at one end 12*a* thereof with first external electrode 28 and a plating layer (unillustrated) formed thereon. First external electrodes 28 are formed by printing silver at one end 12*a* of each of first and second bases 13, 14. The plating layers are formed by applying nickel and tin on first external electrodes 28. First external electrodes 28 may be made of resin silver.

Body 15 is formed of first and second bases 13, 14 by placing them 180 degrees opposite each other. More specifically, the lower surface of second base 14 is joined to the upper surface of first base 13 in such a manner that one end 12*a* of first base 13 and other end 12*b* of second base 14 are in contact with each other, and that other end 12*b* of first base 13 and one end 12*a* of second base 14 are in contact with each other. Body 15 thus formed is box-shaped and has a cross section of square or rectangular shape.

First and second bases 13, 14 can be closely combined with each other by making the borderline between first and second bases 13, 14 pass through center point C on the side surface of body 15 when seen from the side surface. First base 13 may consist of three or more sections of different widths between one end 12*a* and other end 12*b*, unlike the two sections of different widths shown in FIG. 9. The borderline between first and second bases 13, 14 may be straight.

Body 15 is provided at its both ends with second external electrodes 29 disposed in such a manner as to cover first external electrodes 28. Second external electrodes 29 are formed of rectangular-column-shaped electrode caps functioning as connection terminals between element portion 17 and the outside. Second external electrodes 29 are attached to box-shaped body 15 by press-fitting their column portions into both ends of body 15, thereby reinforcing the joint between first and second bases 13, 14.

The plating layers (unillustrated) on first external electrodes 28 improve the joint strength between first external electrodes 28 and second external electrodes 29 when they are welded.

The upper surface of first base 13 and the lower surface of second base 14 are joined with an adhesive. Space portion 16 is formed by facing recess 11*a* of first base 13 and recess 11*b* of second base 14 when the upper surface of first base 13 and the lower surface of second base 14 are joined.

Element portion 17 is made of a highly conductive metal such as silver, copper, nickel, or aluminum. Element portion 17 is disposed in space portion 16 and heated to a high temperature to melt when an overcurrent flows therethrough, thereby blocking the current flow. One end of element portion 17 is disposed on the upper surface at one end 12*a* of first base 13, whereas the other end is disposed on the upper surface at the other end of first base 13. Since the width of first and second bases 13, 14 is smaller at other end 12*b* than at one end 12*a* in its longitudinal direction, one end and the other end of element portion 17 are disposed on different levels. This makes it easy to increase the length of element portion 17.

Since the ends of element portion 17 are connected to the plating layers (unillustrated) formed on first external electrodes 28, element portion 17 can be firmly fixed to first external electrodes 28 by being welded thereto.

A method for producing the surface mount current fuse according to the present second embodiment is described as follows.

Figure 10:
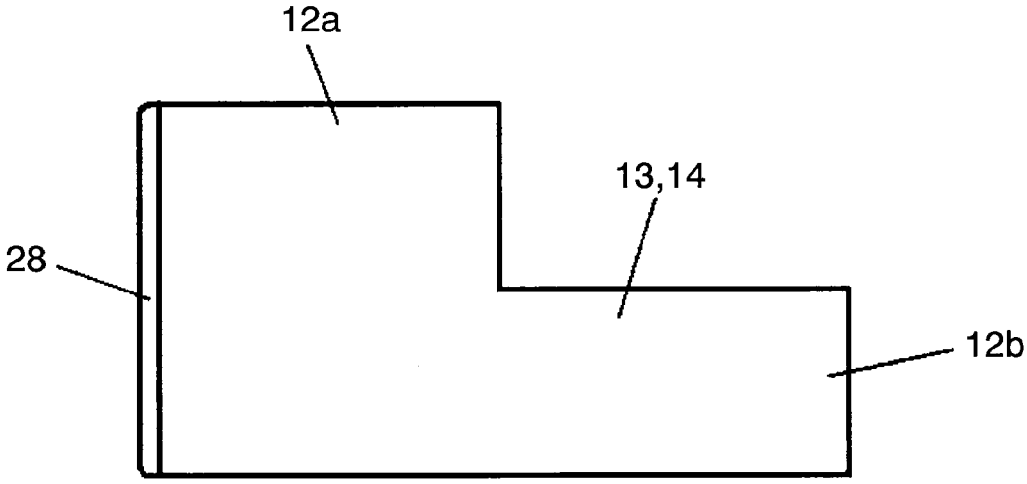
FIG. 10 shows a part of the production method of the surface mount current fuse according to the second embodiment of the present invention.

FIG. 10 shows a part of the production method of the surface mount current fuse according to the present second embodiment.

First of all, first and second bases 13, 14 having recesses 11*a* and 11*b*, respectively, are formed from the same mold. First and second bases 13, 14 have a width smaller at other end 12*b* than at one end 12*a* in their longitudinal direction. Next, as shown in FIG. 10, first external electrodes 28 are formed at an end surface of each of first and second bases 13, 14. Later, the plating layers (unillustrated) are formed on first external electrodes 28.

Next, element portion 17 is extended between the plating layer (unillustrated) on first external electrode 28 of first base 13 and the plating layer (unillustrated) on first external electrode 28 of second base 14. The upper surface of first base 13 and the lower surface of second base 14 are joined in such a manner that one end 12*a* of first base 13 and other end 12*b* of second base 14 are in contact with each other, while the adhesive is being applied to the upper surface of first base 13. As a result, box-shaped body 15 is complete. In this case, recess 11*a* of first base 13 and recess 11*b* of second base 14 are opposed to each other to form space portion 16 in which to dispose element portion 17.

Finally, second external electrodes 29 are disposed on both end surfaces of body 15 in such a manner as to cover first external electrodes 28, thereby completing the surface mount current fuse.

In the present second embodiment, first and second bases 13, 14 can be formed from the same mold because they have substantially the same shape, thereby improving production efficiency.

Furthermore, in the present second embodiment, first external electrodes 28 each having the plating layer (unillustrated) thereon are provided at one end 12*a* of each of first and second bases 13, 14. Therefore, there is no need for applying a plating process to element portion 17 when it is disposed in space portion 16 of body 15. This prevents a plating solution from entering into body 15 and deteriorating element portion 17 and the fusion characteristics thereof.

Third Embodiment

A surface mount current fuse according to a third embodiment of the present invention is described as follows with reference to drawings.

Figure 11:
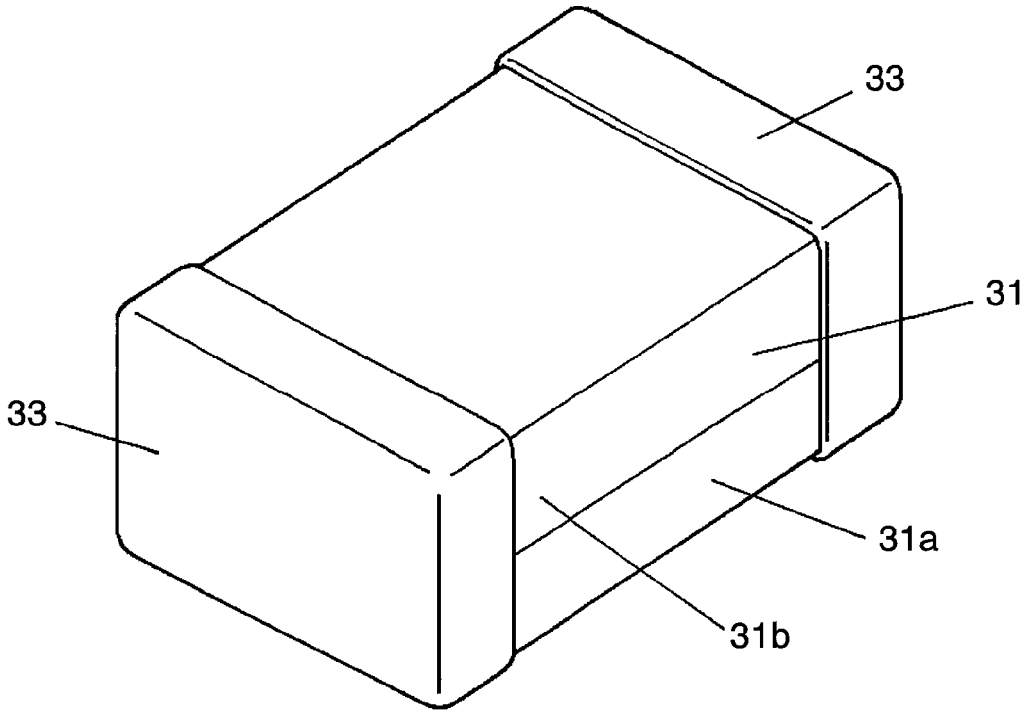
FIG. 11 is a perspective view of a surface mount current fuse according to a third embodiment of the present invention.
Figure 12:
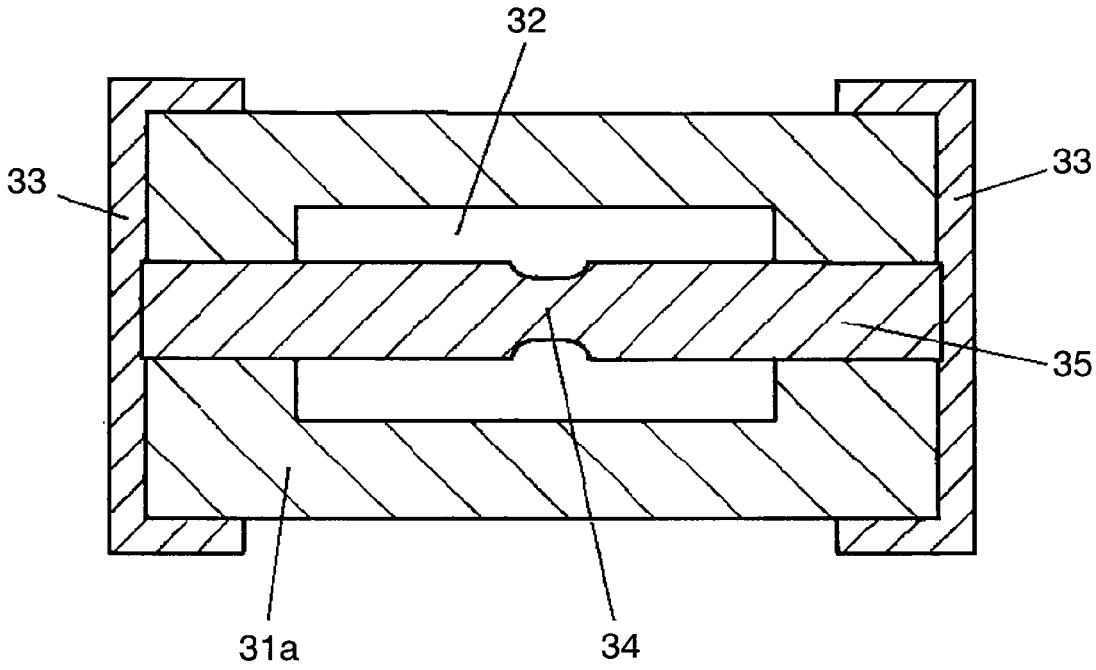
FIG. 12 is a top sectional view of an essential part of the surface mount current fuse according to the third embodiment of the present invention.

FIG. 11 is a perspective view of the surface mount current fuse according to the present third embodiment. FIG. 12 is a top sectional view of an essential part of the surface mount current fuse.

As shown in FIGS. 11 and 12, the surface mount current fuse according to the present embodiment includes insulating case 31, space portion 32 formed in case 31, third external electrodes 33 disposed at both ends of case 31, and element portion 35 having melting portion 34 formed in space portion 32. Element portion 35 is electrically connected to third external electrodes 33. Melting portion 34 is formed by cutting away part of element portion 35.

Case 31 is made of insulating ceramic such as alumina or insulating resin such as epoxy. Case 31 has a square column shape formed of bottom 31*a* and lid 31*b* joined with an adhesive, and includes space portion 32.

Third external electrodes 33 at both ends of case 31 are formed of rectangular-column-shaped electrode caps functioning as connection terminals with the outside. The rectangular-column-shaped electrode caps are attached to body 15 by press-fitting their column portions into both ends of case 31. Third external electrodes 33 may be formed by printing silver.

The cutting away of the part of the center of element portion 35 to form melting portion 34 is performed by a mechanical process such as scribing or punching. Melting portion 34, which melts when a current above a certain level flows therethrough, is formed in space portion 32.

Providing melting portion 34 in space portion 32 prevents the heat generated in melting portion 34 from radiating to the outside, allowing melting portion 34 to be heated to a higher temperature. As a result, melting portion 34 can be securely melted at a predetermined current. Melting portion 34 may be melted more quickly by applying glass or metal having a low melting point thereto so as to accumulate heat.

Element portion 35 is circular, square, or foil-shaped in cross section and is linear in shape. Element portion 35 is extended between third external electrodes 33 and electrically connected thereto. Element portion 35 is made of highly conductive metal such as silver, copper, nickel, or aluminum and is provided at its center with melting portion 34 to be disposed in space portion 32. Both ends of element portion 35 are placed on the upper surfaces at both ends of bottom 31*a* of case 31.

A method for producing the surface mount current fuse according to the present third embodiment is described as follows.

First, as shown in FIGS. 11 and 12, element portion 35 is placed on the upper surfaces at both ends of bottom 31*a* of case 31 including space portion 32. The center of element portion 35 is disposed in space portion 32.

Next, the center of element portion 35 disposed in space portion 32 is cut away by scribing, punching, or the like to form melting portion 34. The cutting is performed with the resistance kept constant. Alternatively, melting portion 34 may be formed in advance.

Finally, lid 31*b* and bottom 31*a* of case 31 are joined with an adhesive, and then third external electrodes 33 formed of rectangular-column-shaped electrode caps are disposed at both ends of case 31. Third external electrodes 33 are electrically connected to element portion 35.

In the present third embodiment, the fusion characteristics of melting portion 34 formed by cutting away part of element portion 35 can be adjusted by varying the diameter of melting portion 34. In addition, the constant resistance of melting portion 34 allows the determination of the fusing time.

Even when element portion 35 has a large circular cross sectional area, melting portion 34 can have a small cross sectional area because it is formed by cutting away part of element portion 35 as in the present third embodiment. As a result, a current concentrates on melting portion 34, allowing it to melt quickly.

When having a circular or similar cross section, element portion 35 does not easily melt because its surface area is too small to generate radiation. However, the surface area can be increased by making the cross section of element portion 35 sheet-like so as to increase the radiation and hence to facilitate the fusion.

Figure 13:
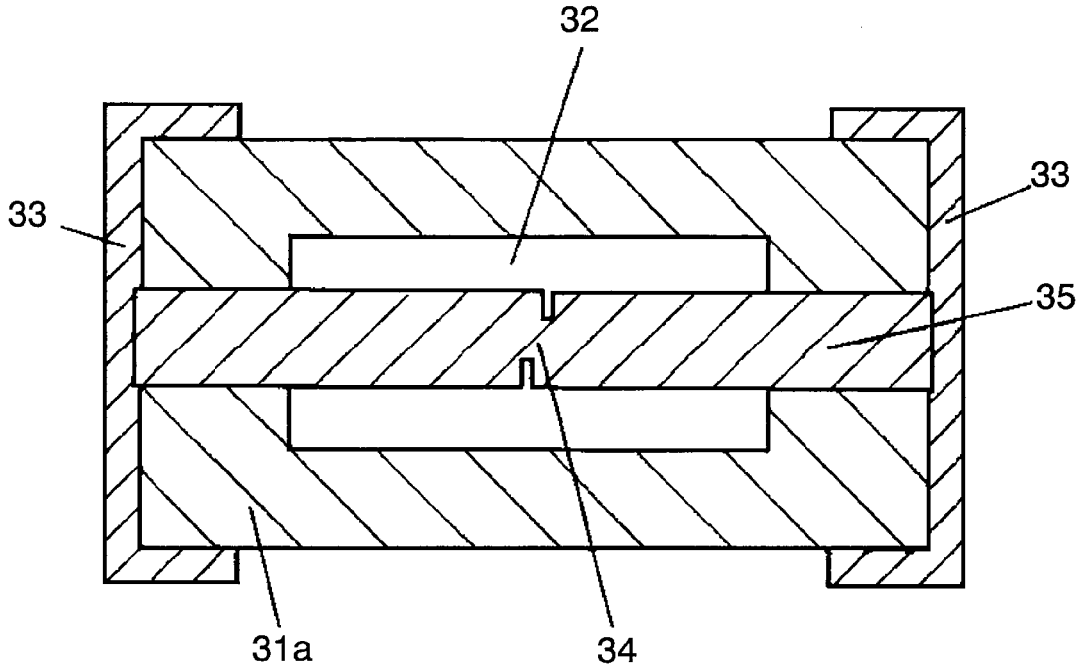
FIG. 13 is a top sectional view of an essential part of another example of the surface mount current fuse according to the third embodiment of the present invention.

FIG. 13 is a top sectional view of an essential part of another example of the surface mount current fuse according to the present third embodiment. As shown in FIG. 13, the cutting away of element portion 35 can be performed using a laser so as to improve the precision of obtaining the predetermined resistance.

Fourth Embodiment

A surface mount current fuse according to a fourth embodiment of the present invention is described as follows with reference to drawings.

Figure 14:
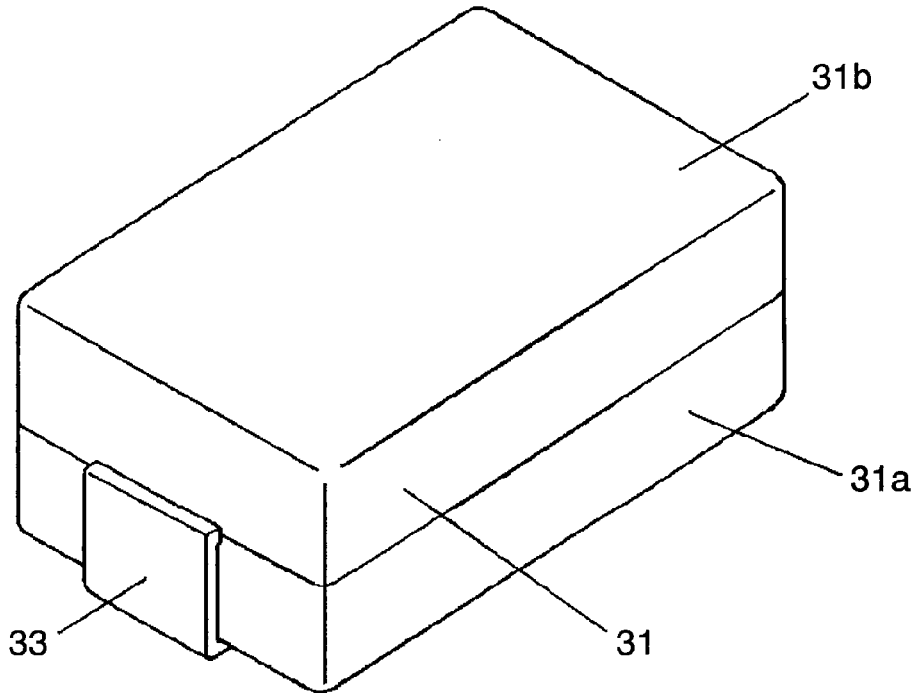
FIG. 14 is a perspective view of a surface mount current fuse according to a fourth embodiment of the present invention.
Figure 15:
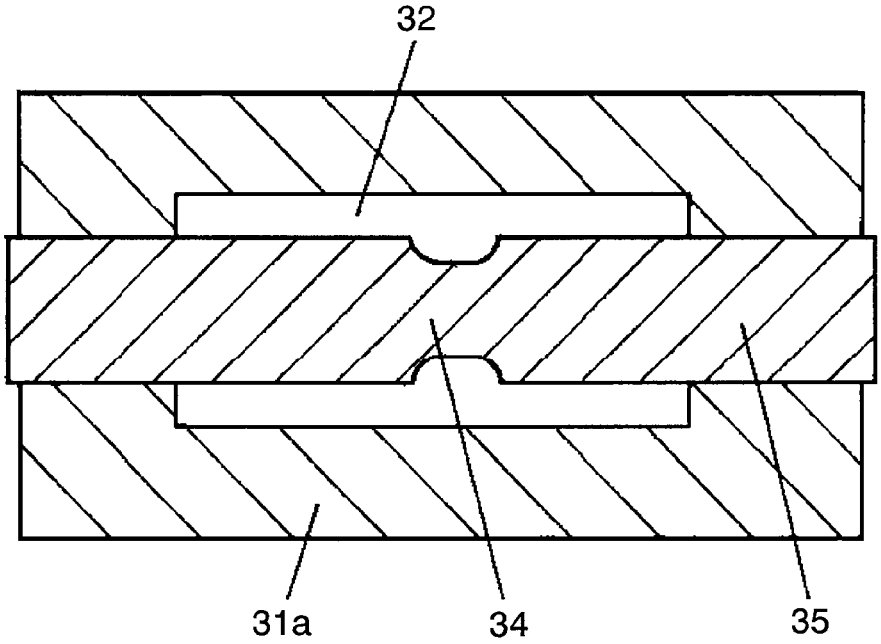
FIG. 15 is a top sectional view of an essential part of the surface mount current fuse according to the fourth embodiment of the present invention.

FIG. 14 is a perspective view of the surface mount current fuse according to the present fourth embodiment. FIG. 15 is a top sectional view of an essential part of the surface mount current fuse.

The present embodiment differs from the third embodiment in that element portion 35 and third external electrodes 33 are made integrally of the same metal as shown in FIGS. 14 and 15. Third external electrodes 33 are bent along the end surfaces of bottom 31*a* and the rear surface of case 31.

Element portion 35 and third external electrodes 33 made integrally of the same metal save the trouble of connecting them, thereby improving production efficiency.

Figure 16:
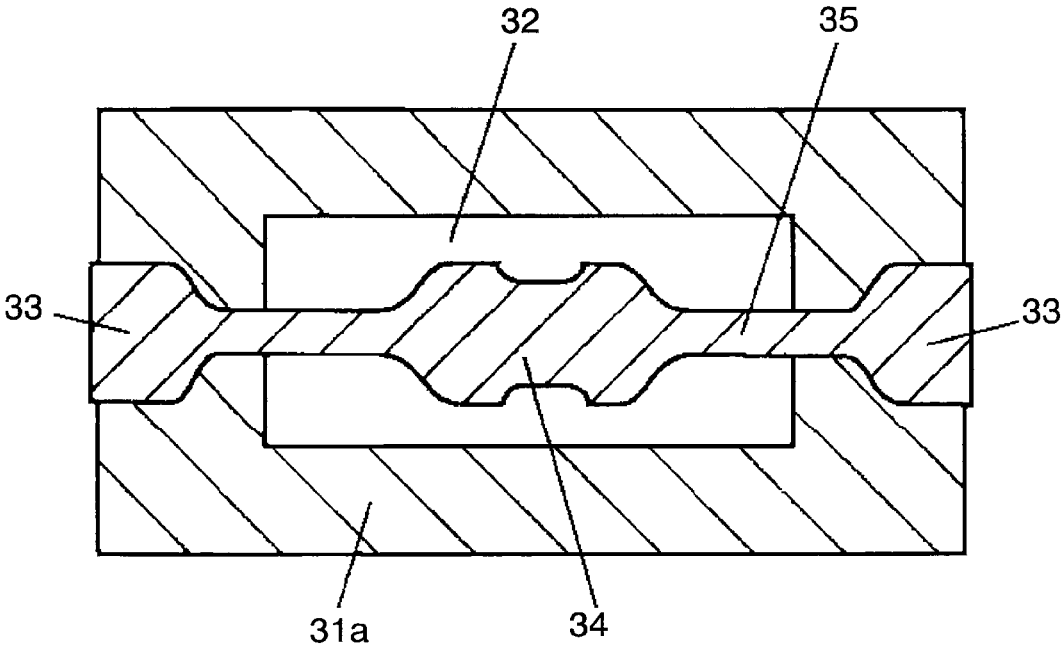
FIG. 16 is a top sectional view of an essential part of another example of the surface mount current fuse according to the fourth embodiment of the present invention.

FIG. 16 is a top sectional view of an essential part of another example of the surface mount current fuse according to the present fourth embodiment.

Melting portion 34 of element portion 35 may be thinner than the remaining part of element portion 35 so that it can be cut easily and precisely. Alternatively, third external electrodes 33 may be made thinner than element portion 35 so that third external electrodes 33 can be bent easily along case 31 and used as connection terminals. This makes it unnecessary to provide separate connection terminals. Third external electrodes 33 or melting portion 34 are made thinner preferably by being rolled.

In the third and fourth embodiments, melting portion 34 is formed by cutting away part of element portion 35, but may alternatively be formed by irradiating part of element portion 35*a* with a laser. In this case, the part irradiated with the laser is deteriorated to increase the resistance, making element portion 35 easier to melt without cutting it away. As a result, the fusion characteristics become adjustable.

Melting portion 34 of element portion 35 may be formed of two or more layers of metal. In this case, melting portion 34 can be alloyed or eutectic alloyed by the laser irradiation, thereby increasing its resistance. As a result, melting portion 34 can melt more easily, making the fusion characteristics adjustable.

The use of laser irradiation allows melting portion 34 to have a higher resistance and hence to make it easier to melt. Therefore, even in the case where element portion 35 has a large cross sectional area so as not to break when a large current such as a surge current flows therethrough, melting portion 34 can melt at the predetermined current.

Fifth Embodiment

A surface mount current fuse according to a fifth embodiment of the present invention is described as follows with reference to drawings.

Figure 17:
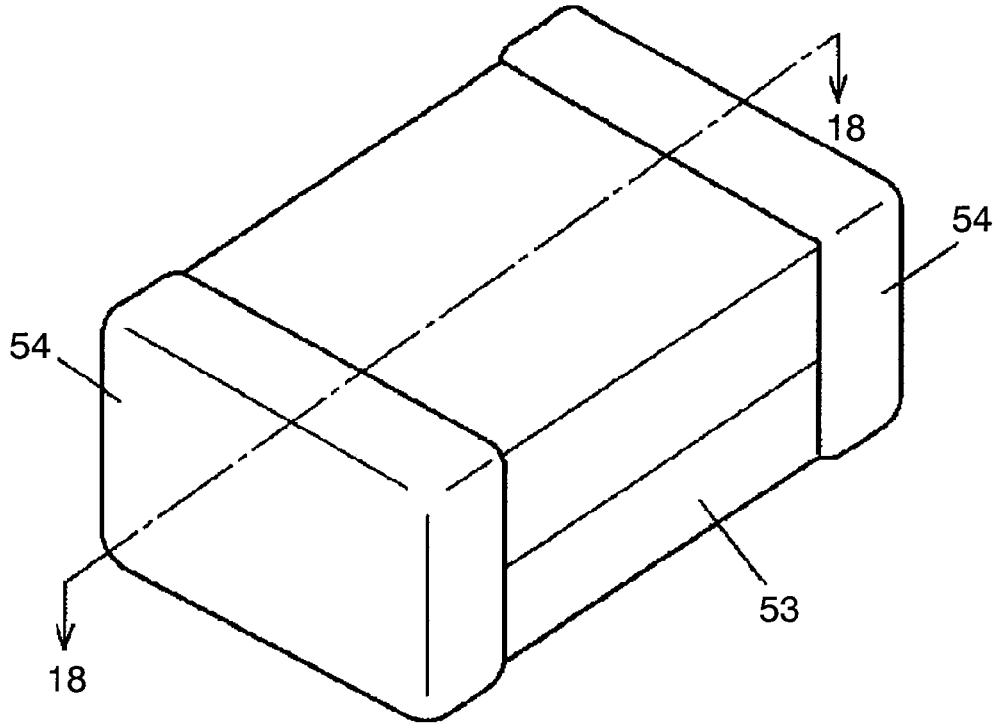
FIG. 17 is a perspective view of a surface mount current fuse according to a fifth embodiment of the present invention.
Figure 18:
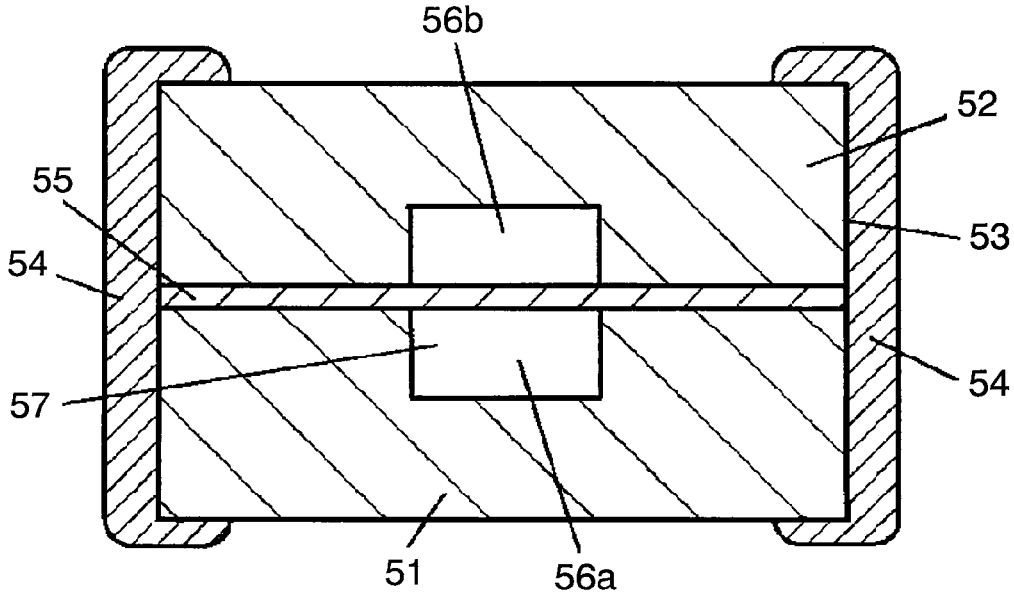
FIG. 18 is a sectional view taken along line 18-18 of FIG. 17.

FIG. 17 is a perspective view of the surface mount current fuse according to the present fifth embodiment. FIG. 18 is a sectional view taken along line 18-18 of FIG. 17.

As shown in FIGS. 17 and 18, the surface mount current fuse according to the present embodiment includes first base 51 made of resin, second base 52 made of resin and disposed on the upper surface of first base 51, body 53 formed of first base 51 and second base 52, a pair of third external electrodes 54 disposed at both ends of body 53, and element portion 55 connected to third external electrodes 54 and disposed between the upper surface of first base 51 and the lower surface of second base 52. The upper surface of first base 51 and the lower surface of second base 52 are provided with recesses 56*a* and 56*b*, respectively. Recesses 56*a* and 56*b* are opposed to each other to form space portion 57 in which to dispose element portion 55.

First and second bases 51, 52 are made of insulating resin such as epoxy, and have a square column shape. Element portion 55 is disposed on the upper surface of first base 51, and second base 52 is disposed on element portion 55. First and second bases 51, 52 are joined with an adhesive to form body 53, which is provided at its both ends with the pair of third external electrodes 54.

The pair of third external electrode 54 are formed of rectangular-column-shaped electrode caps, which are attached to body 53 by press-fitting their column portions into both ends of body 53. Element portion 55, which is circular in cross section and is linear in shape, is electrically connected to the pair of third external electrodes 54 at the upper surface of first base 51 and the lower surface of second base 52. Element portion 55 is made of highly conducive metal such as silver, copper, nickel, or aluminum and melts when a current above a certain level flows therethrough.

Both ends of element portion 55 may be extended to the end surfaces of body 53. When rectangular-column-shaped electrode caps are used as third external electrodes 54, their column portions can be fitted into both ends of body 53 so as to sandwich both ends of element portion 55 between body 53 and the rectangular-column-shaped electrode caps. This facilitates the electrical connection between element portion 55 and third external electrodes 54 formed of the rectangular-column-shaped electrode caps.

Figure 19:
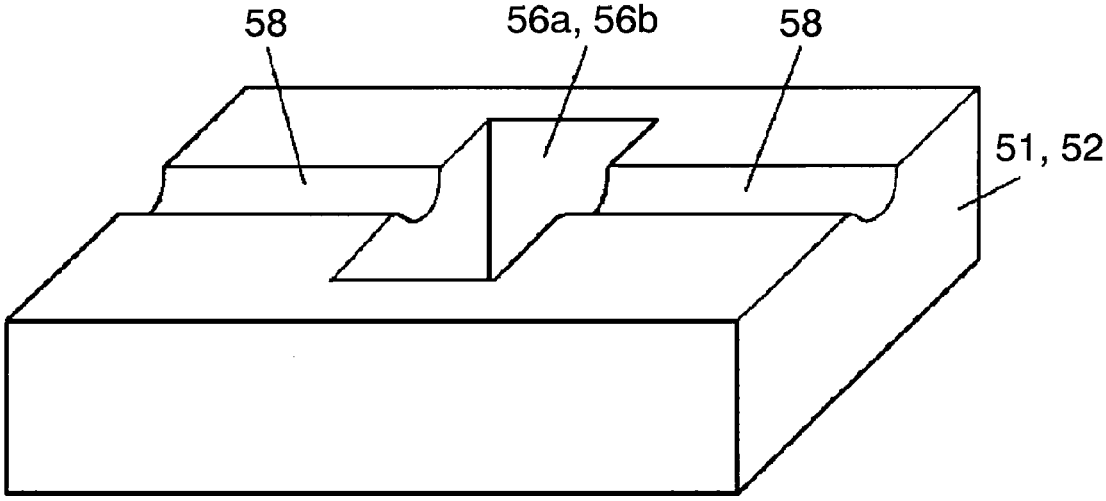
FIG. 19 is a perspective view of an essential part of another example of the surface mount current fuse according to the fifth embodiment of the present invention.

FIG. 19 is a perspective view of an essential part of another example of the surface mount current fuse according to the present embodiment. In FIG. 19, there is provided second groove 58 formed adjacent to at least one of recess 56*a* in the upper surface of first base 51 and recess 56*b* in the lower surface of second base 52. Second groove 58 is shallower than recesses 56*a* and 56*b*. Element portion 55 can be placed in second groove 58 to stabilize the position of element portion 55 and to reduce the height of body 53.

Recesses 56*a* and 56*b* are formed in the center of the upper surface of first base 51 and the center of the lower surface of second base 52, respectively. Their openings may be any shape such as circular or square. Recesses 56*a* and 56*b* are formed by compressing by a press the resin composing first base 51 and the resin composing second base 52. Recesses 56*a* and 56*b* are opposed to each other to form space portion 57 in which to expose part of element portion 55. This prevents the heat generated in element portion 55 from radiating to the outside, allowing element portion 55 to be heated to a high temperature. As a result, element portion 55 can be securely melted at a predetermined current value.

Body 53 may be covered on its upper, lower, and side surfaces with a heat-shrinkable tube (unillustrated) made of flame-retardant resin such as polyolefin. The heat-shrinkable tube (unillustrated) can block element portion 55 from the entry of solder through the joint between first and second bases 51, 52 during solder dipping.

A method for producing the surface mount current fuse according to the present fifth embodiment is described as follows.

Figure 20A:
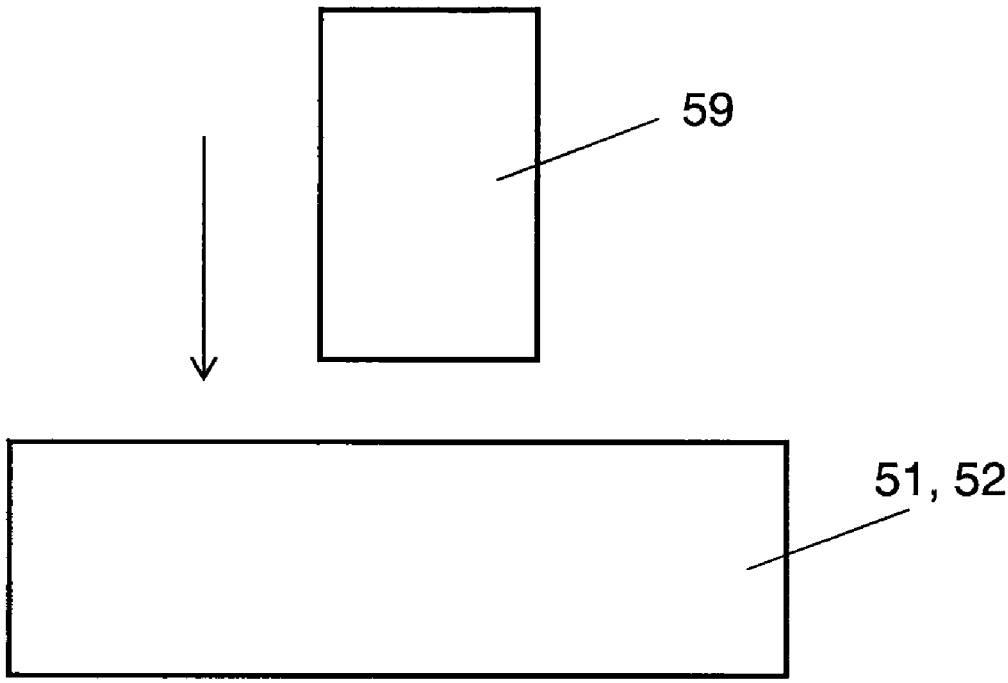
FIG. 20A shows a part of the production process of the surface mount current fuse according to the fifth embodiment of the present invention.
Figure 20B:
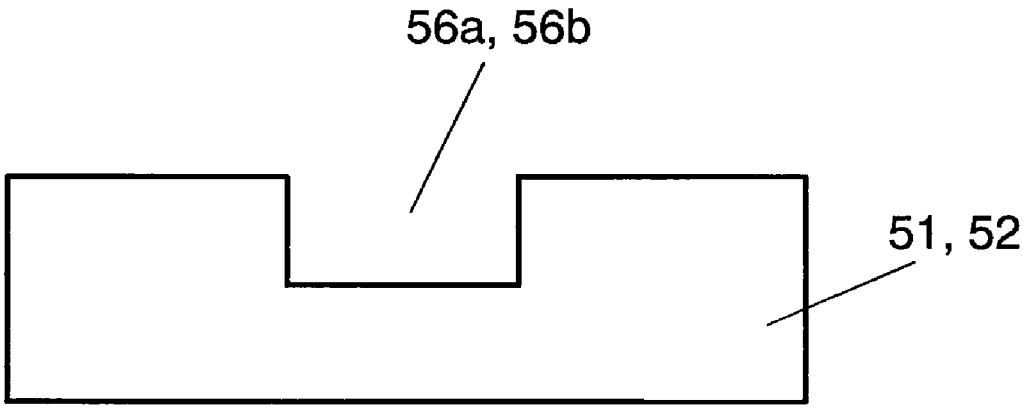
FIG. 20B shows a part of the production process of the surface mount current fuse according to the fifth embodiment of the present invention.

FIGS. 20A and 20B show parts of the production process of the surface mount current fuse according to the present fifth embodiment. As shown in FIGS. 20A and 20B, the center of the upper surface of first base 51 made of resin and the center of the lower surface of second base 52 made of resin are compressed by pressing device 59 to form recesses 56*a* and 56*b*. Then, first and second bases 51, 52 are heated to be hardened.

Next, element portion 55 is placed on the upper surface of first base 51 having recess 56*a* as shown in FIG. 18.

Second base 52 is placed on the upper surface of element portion 55 in such a manner that recess 56*a* of first base 51 and recess 56*b* of second base 52 are opposed to each other. Two recesses 56*a* and 56*b* form space portion 57 in which to dispose element portion 55. Then, the upper surface of first base 51 and the lower surface of second base 52 are joined with an adhesive so as to form body 53 consisting of first base 51 and second base 52.

Finally, third external electrodes 54 formed of rectangular-column-shaped electrode caps are press-fitted into both ends of body 53, thereby completing the surface mount current fuse.

In the present fifth embodiment, first and second bases 51, 52 are made of resin. This allows recesses 56*a* and 56*b* to be formed easily, thus improving production efficiency, and first and second bases 51, 52 to be lighter-weight than those made of ceramic material. Furthermore, the size and shape of recesses 56*a* and 56*b*, which are formed not by being molded but by being pressed, can be changed easily and quickly depending on required characteristics or the like.

Recesses 56*a* and 56*b* are formed by compressing the resin composing first base 51 and the resin composing second base 52, so that the compressed portions have a higher density than the remaining portions. This increases the mechanical strength of the surface mount current fuse.

Sixth Embodiment

A surface mount current fuse according to a sixth embodiment of the present invention is described as follows with reference to drawings.

Figure 21:
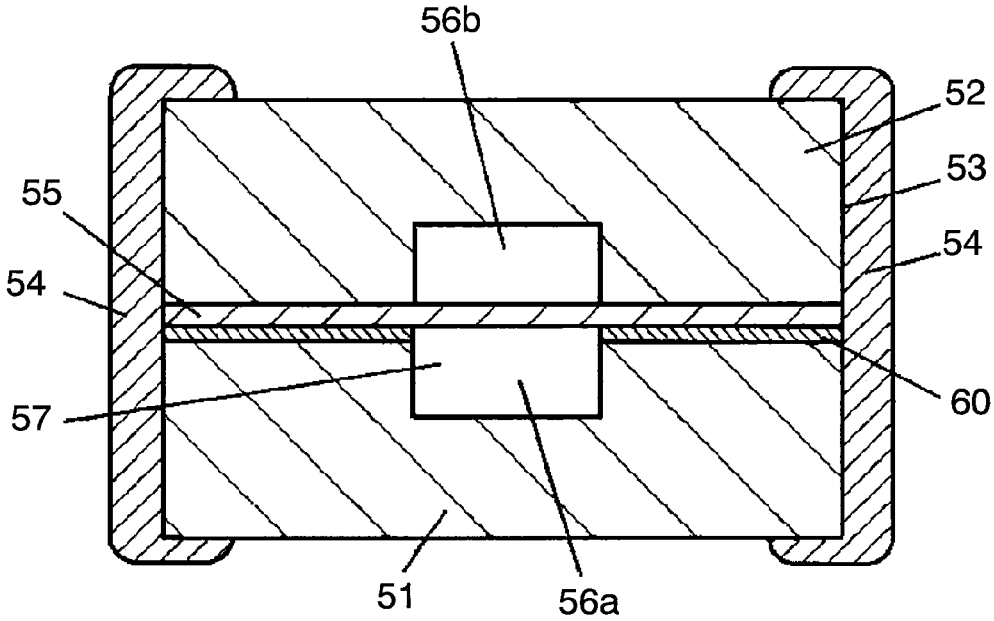
FIG. 21 is a sectional view of the surface mount current fuse according to the sixth embodiment of the present invention.

FIG. 21 is a sectional view of the surface mount current fuse according to the present sixth embodiment. The present embodiment differs from the fifth embodiment in that there is provided metal layer 60 adjacent to recess 56*a* in the upper surface of first base 51 as shown in FIG. 21. Metal layer 60 is made of a metal such as copper or copper nickel, and is joined to first and second bases 51, 52 by thermocompression bonding.

With this structure, the position of element portion 55 can be stabilized by temporarily joining element portion 55 to metal layer 60 before second base 52 is disposed on the upper surface of element portion 55.

Figure 22:
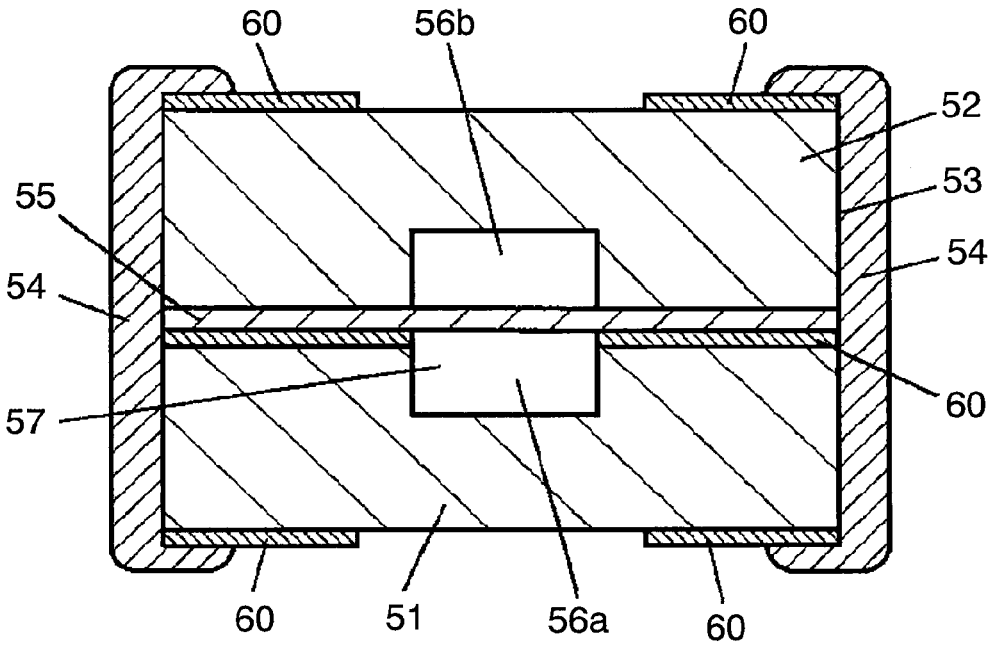
FIG. 22 is a sectional view of another example of the surface mount current fuse according to the sixth embodiment of the present invention.

FIG. 22 is a sectional view of another example of the surface mount current fuse according to the present sixth embodiment. As shown in FIG. 22, metal layer 60 may be additionally disposed both on the upper and lower surfaces at both ends of body 53. When third external electrodes 54 formed of electrode caps are caulked with body 53, metal layers 60 disposed on the upper and lower surfaces at both ends of body 53 prevent cracking of body 53.

Seventh Embodiment

A surface mount current fuse according to a seventh embodiment of the present invention is described as follows with reference to drawings.

Figure 23:
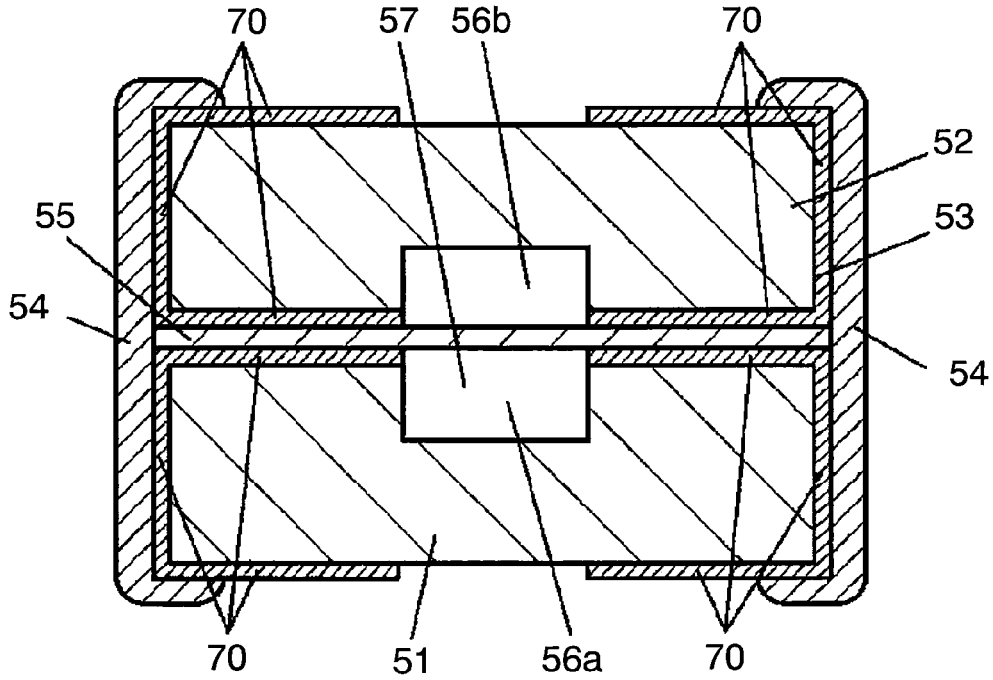
FIG. 23 is a sectional view of a surface mount current fuse according to a seventh embodiment of the present invention.

FIG. 23 is a sectional view of the surface mount current fuse according to the present seventh embodiment.

The present embodiment differs from the fifth embodiment in that, as shown in FIG. 23, there are provided a pair of metal films 70 at both ends of each of first and second bases 51, 52 in such a manner as to integrally cover at least the upper, lower, and end surfaces thereof, and that metal films 70 are connected to the upper and lower surfaces of element portion 55. Metal films 70 are made of a metal such as nickel, iron, copper, or tin and formed to have a lateral U-shaped cross section. Metal films 70 are either press-fitted to or bonded with first and second bases 51, 52.

Body 53 is provided at its both ends with a pair of third external electrodes 54 to be connected to metal films 70. The pair of third external electrodes 54 are formed by printing and sintering a metal such as Ag. Third external electrodes 54 are thinner than those formed of electrode caps.

In the present seventh embodiment, metal films 70 connected to element portion 55 are extended to the upper, lower, and end surfaces of body 53. Therefore, applying a current to metal films 70 on the upper and lower surfaces of body 53 makes it possible to connect metal film 70 on the upper surface of first base 51 and metal film 70 on the lower surface of second base 51, and to weld element portion 55 and metal films 70 at the same time.

The pair of third external electrodes 54 connected to metal films 70 at both ends of body 53 securely prevent element portion 55 from being exposed to the outside.

If metal film 70 on first base 51 and metal film 70 on second base 52 are made of different materials from each other, the contact resistance between metal film 60 on first base 51 and metal film 70 on second base 52 increases, thereby improving the welding strength.

Eighth Embodiment

A surface mount current fuse according to an eighth embodiment of the present invention is described as follows with reference to drawings.

Figure 24:
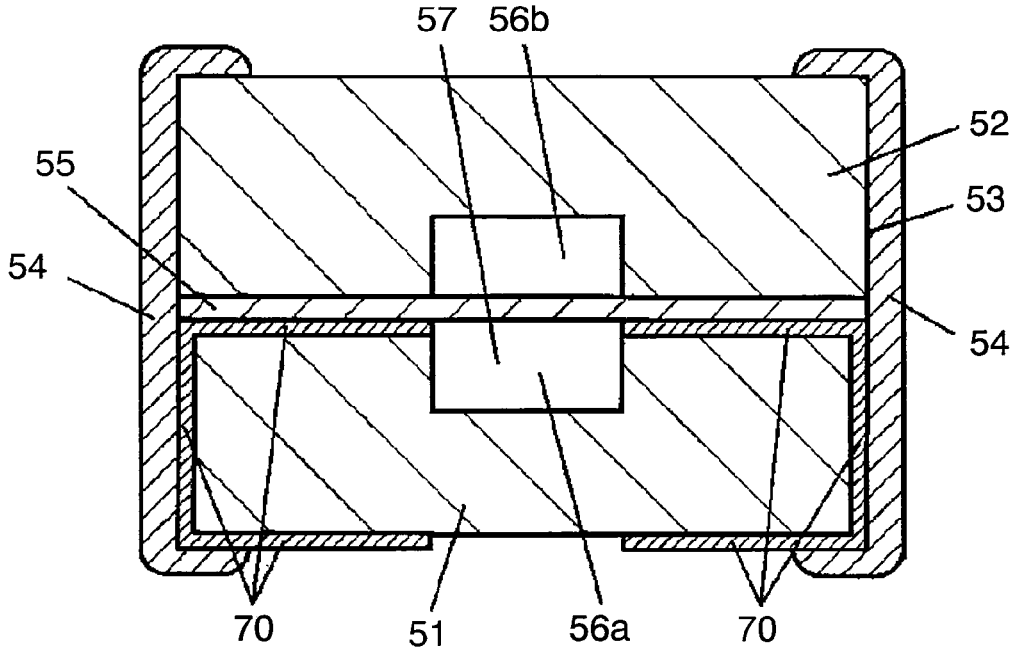
FIG. 24 is a sectional view of a surface mount current fuse according to an eighth embodiment of the present invention.

FIG. 24 is a sectional view of the surface mount current fuse according to the present eighth embodiment. The present embodiment differs from the seventh embodiment in that, as shown in FIG. 24, metal film 70 is provided to only one of first and second bases 51, 52.

With this structure, only one metal film 70 is welded to third external electrodes 54, while two metal films 70 are welded in the seventh embodiment. As a result, the load for welding is reduced to prevent oxidation of third external electrodes 54.

Figure 25:
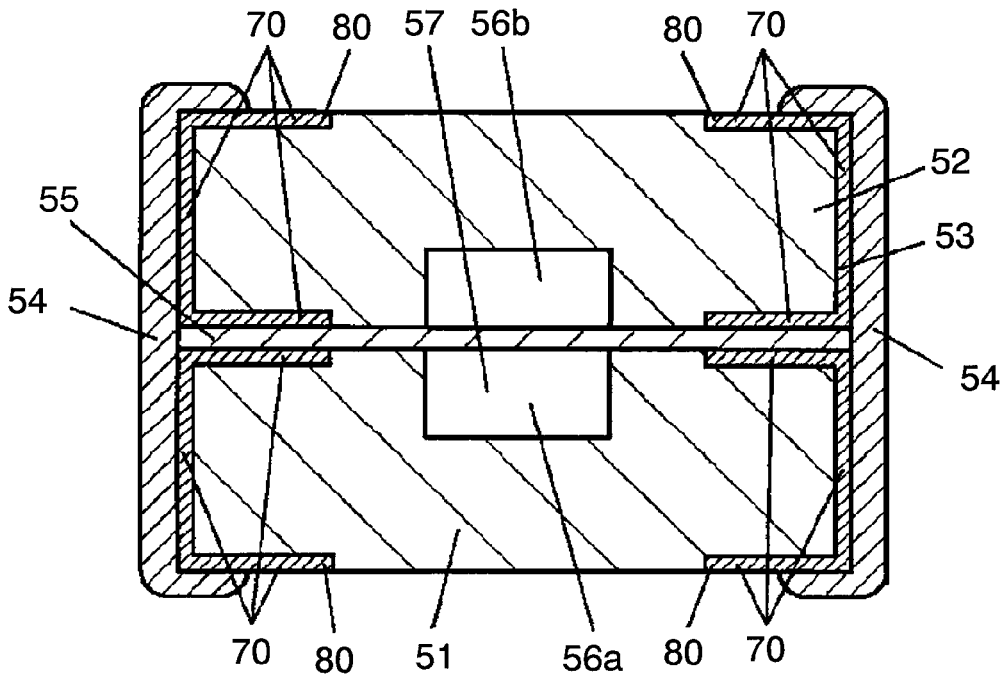
FIG. 25 is a sectional view of another example of the surface mount current fuse according to the eighth embodiment of the present invention.

FIG. 25 is a sectional view of another example of the surface mount current fuse according to the present eighth embodiment. As shown in FIG. 25, first and second bases 51, 52 are provided at their both ends with notch portions 80 in which to insert metal films 70. As a result, both ends of first and second bases 51, 52 are on the same axis as the center thereof. This center refers to the center point when the element portion extending in the longitudinal direction is seen from third external electrode 54 side.

In this case, metal films 70 are inserted in notch portions 80, so that third external electrodes 54 can be closer to the inner side of the body 53 by the thickness of metal films 70, thereby reducing the height of body 53.

Figure 26:
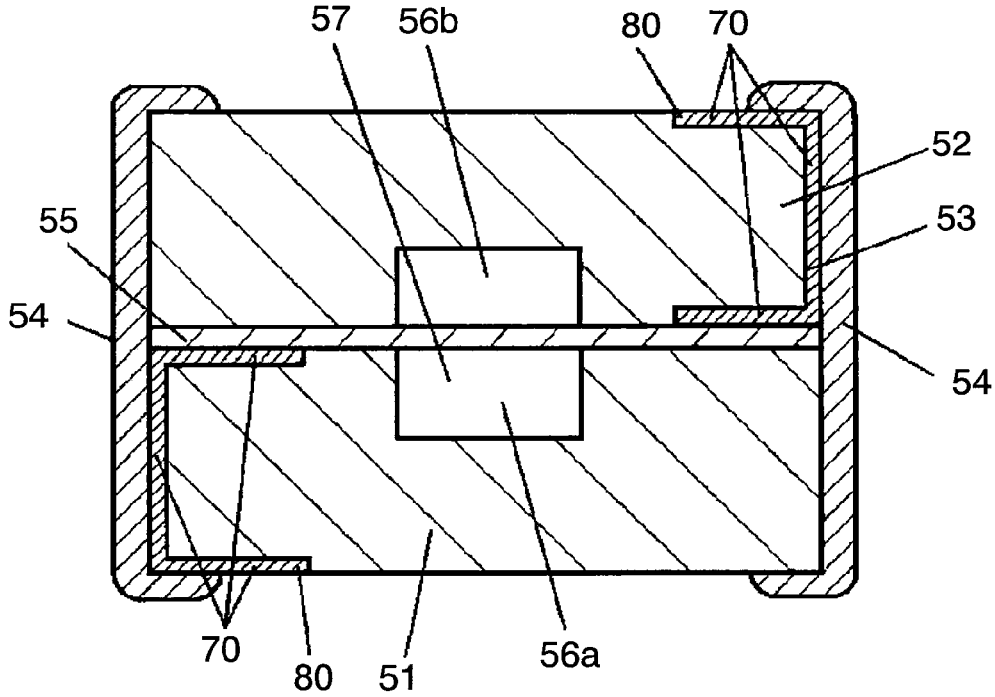
FIG. 26 is a sectional view of another example of the surface mount current fuse according to the eighth embodiment of the present invention.
Figure 27:
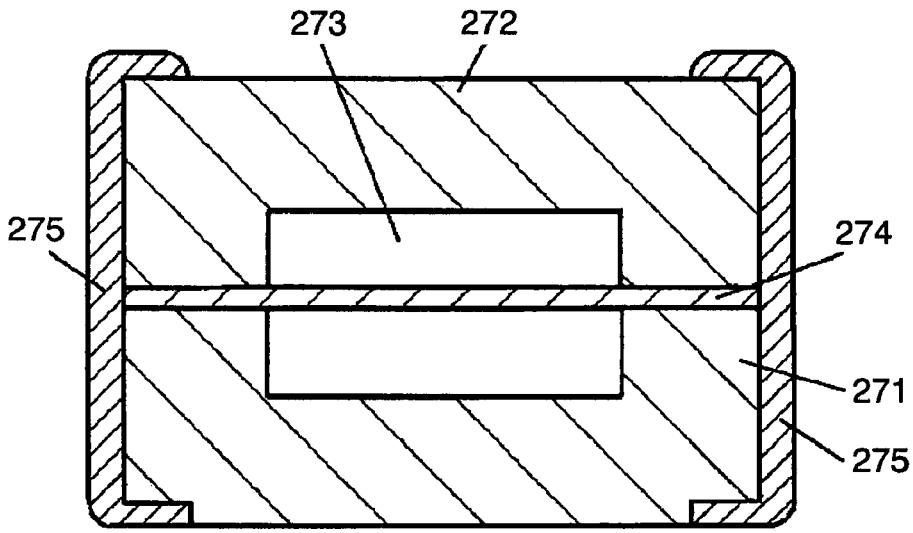
FIG. 27 is a sectional view of a conventional surface mount current fuse.
Figure 28:
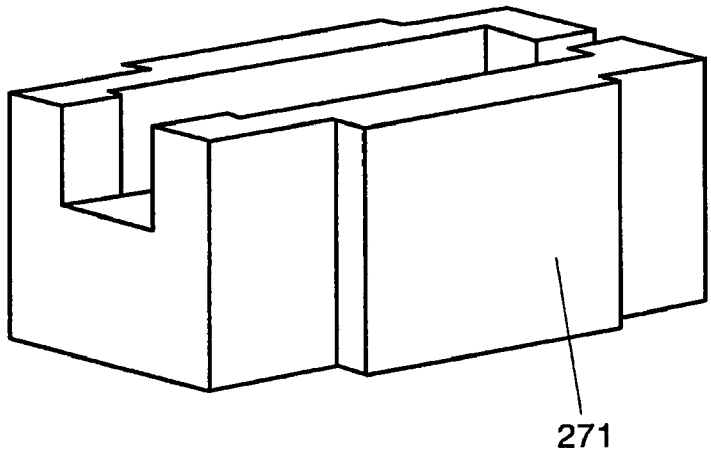
PRIOR ART FIG. 28
FIG. 28 is a perspective view of an essential part of the conventional surface mount current fuse.

FIG. 26 is a sectional view of another example of the surface mount current fuse according to the present eighth embodiment. As shown in FIG. 26, notch portions 80 in which to insert metal films 70 are provided to only one end of first base 51 and one end of second base 52. Metal film 70 of first base 51 and metal film 70 of second base 52 may be disposed diagonally so as not to face each other.

With this structure, metal films 70 are provided in a zigzag manner. This allows first and second bases 51, 52 to be formed in the same shape, that is, to have notch portions 80 at the same positions. Therefore, only one mold is required, thus improving production efficiency.

In the seventh and eighth embodiments, first and second bases 51, 52 may be made of ceramic material.

INDUSTRIAL APPLICABILITY

The surface mount current fuse according to the present invention is production efficient, and therefore, is useful as a surface mount current fuse which melts when an overcurrent flows therethrough to protect electronic devices.

The invention claimed is:

1. A surface mount current fuse comprising:

a first base (13) having a recess (11*a*), the first base (13) being smaller in width between a bottom surface and an upper surface at an other longitudinal end (12*b*) than between the bottom surface and the upper surface at one longitudinal end (12*a*) so as to be asymmetrical in a longitudinal direction of the first base (13); and a second base (14) having a recess (11*b*), the second base (14) being smaller in width between a bottom surface and an upper surface at an other longitudinal end (12*b*) than between the bottom surface and the upper surface at one longitudinal end (12*a*) so as to be asymmetrical in a longitudinal direction of the second base (14), the second base having a same shape as the first base, wherein the first base (13) and the second base (14) are combined to form a box-shaped body (15) by joining a lower surface of the second base (14) to the upper surface of the first base (13) in such a manner that the one longitudinal end (12*a*) of the first base (13) and the other longitudinal end (12*b*) of the second base (14) are in contact with each other;

the recess (11*a*) of the first base (13) and the recess (11*b*) of the second base (14) form a space portion (16) in which to place an element portion (17); and when a junction boundary between the first base (13) and the second base (14) is projected on a side surface of the body (15), a borderline between the first base (13) and the second base (14) passes through a center point (C) on the side surface of the body (15).

2. The surface mount current fuse of claim 1, wherein each of the first base and the second base has a width on a side of the one longitudinal end and a width on a side of the other longitudinal end of a center line, and wherein the width on the side of the one longitudinal end is larger than the width on the side of the other longitudinal end.

3. The surface mount current fuse of claim 1, wherein each of the first base and the second base has a width linearly varying from the one longitudinal end to the other longitudinal end.

4. The surface mount current fuse of claim 1, wherein each of the first base and the second base has a plurality of first grooves at the one longitudinal end, and the element portion is extended between one of the first grooves at the one longitudinal end of the first base and one of the first grooves at the one longitudinal end of the second base.

5. The surface mount current fuse of claim 1, further comprising:

first external electrodes at the one longitudinal end of the first base and at the one longitudinal end of the second base, the first external electrodes each having a plating layer thereon.

6. The surface mount current fuse of claim 5, wherein the plating layers are connected to ends of the element portion.

7. The surface mount current fuse of claim 5, further comprising:

second external electrodes at both ends of the body, the second external electrodes covering the first external electrodes.

8. The surface mount current fuse of claim 1, wherein the element portion has a melting portion formed by cutting away part of the element portion.

9. The surface mount current fuse of claim 8, wherein the cutting is performed using a laser.

10. The surface mount current fuse of claim 8, further comprising:

third external electrodes at both ends of the body, the third external electrodes being formed integrally with the element portion from a same metal.

11. The surface mount current fuse of claim 10, wherein the melting portion is thinner than a remaining part of the element portion.

12. The surface mount current fuse of claim 10, wherein the third external electrodes are thinner than the element portion.

13. The surface mount current fuse of claim 1, wherein the element portion has a melting portion formed by irradiating part of the element portion with a laser.

14. The surface mount current fuse of claim 13, further comprising:

third external electrodes at both ends of the body, the third external electrodes being formed integrally with the element portion from a same metal.

15. The surface mount current fuse of claim 14, wherein the third external electrodes are thinner than the element portion.

16. The surface mount current fuse of claim 13, wherein the melting portion is formed of at least two layers of metal.

* * * * *